US010566155B2

(12) United States Patent
Tsukao et al.

(10) Patent No.: US 10,566,155 B2
(45) Date of Patent: Feb. 18, 2020

(54) SWITCH

(71) Applicant: MITSUBISHI ELECTRIC CORPORATION, Tokyo (JP)

(72) Inventors: Yasuhiro Tsukao, Tokyo (JP); Katsushi Nakada, Tokyo (JP)

(73) Assignee: MITSUBISHI ELECTRIC CORPORATION, Chiyoda-Ku, Tokyo (JP)

( * ) Notice: Subject to any disclaimer, the term of this patent is extended or adjusted under 35 U.S.C. 154(b) by 0 days.

(21) Appl. No.: 16/089,165

(22) PCT Filed: Apr. 6, 2016

(86) PCT No.: PCT/JP2016/061270
§ 371 (c)(1),
(2) Date: Sep. 27, 2018

(87) PCT Pub. No.: WO2017/175336
PCT Pub. Date: Oct. 12, 2017

(65) Prior Publication Data

US 2019/0371546 A1 Dec. 5, 2019

(51) Int. Cl.
*H01H 31/00* (2006.01)
*H01H 33/90* (2006.01)

(52) U.S. Cl.
CPC ..... *H01H 31/003* (2013.01); *H01H 33/901* (2013.01)

(58) Field of Classification Search
CPC .. H01H 31/003; H01H 31/026; H01H 33/901; H01H 33/02; H01H 33/045;
(Continued)

(56) References Cited

U.S. PATENT DOCUMENTS 4,359,616 A * 11/1982 Ueda ..... H01H 33/901 218/57
4,500,762 A * 2/1985 Yoshizumi ..... H01H 33/24 218/12
(Continued)

FOREIGN PATENT DOCUMENTS

JP S63-067297 B2 12/1988
JP H07-249356 A 9/1995
(Continued)

OTHER PUBLICATIONS

International Search Report (PCT/ISA/210) dated Jun. 21, 2016, by the Japan Patent Office as the International Searching Authority for International Application No. PCT/JP2016/061270.
(Continued)

*Primary Examiner* — Edwin A. Leon
*Assistant Examiner* — William A Bolton
(74) *Attorney, Agent, or Firm* — Buchanan Ingersoll & Rooney PC

(57) ABSTRACT

A switch includes: a first contact and a second contact placed on an operation axis and facing each other; an urging part that urges the second contact to a first contact side; and a second magnetic material part that engages with the second contact to restrict the second contact from moving to the first contact side. The switch also includes: a conductor part that passes current when an arc is formed between the first contact and the second contact; and a first magnetic material part that surrounds the conductor part. When current flows through the conductor part, the second magnetic material part is disengaged from the second contact.

4 Claims, 11 Drawing Sheets

(58) Field of Classification Search
CPC .... H01H 33/12; H01H 33/187; H01H 33/185; H01H 33/664
USPC ..... 218/55, 45, 67, 68, 79, 80, 97, 100, 13, 218/18
See application file for complete search history.

(56) References Cited

U.S. PATENT DOCUMENTS

| | | | | |
|---|---|---|---|---|
| 5,091,614 | A * | 2/1992 | Yamamoto | H01H 33/16 218/143 |
| 5,483,031 | A * | 1/1996 | Matsuda | H01H 1/385 218/48 |
| 9,117,608 | B2 * | 8/2015 | Nakada | H01H 33/62 |
| 2009/0166168 | A1 | 7/2009 | Nakauchi et al. | |
| 2013/0248492 | A1 * | 9/2013 | Froebel | H01H 1/385 218/18 |

FOREIGN PATENT DOCUMENTS

| | | | |
|---|---|---|---|
| JP | 2009-163946 | A | 7/2009 |
| JP | 2012-151001 | A | 8/2012 |

OTHER PUBLICATIONS

Written Opinion (PCT/ISA/237) dated Jun. 21, 2016, by the Japan Patent Office as the International Searching Authority for International Application No. PCT/JP2016/061270.

* cited by examiner

SWITCH

FIELD

The present invention relates to a switch including a fixed contact and a movable contact.

BACKGROUND

A gas-insulated switching apparatus includes switches that each connect and disconnect a circuit by causing a movable contact and a fixed contact to make contact and separate with each other. Such switches include a grounding switch used for grounding a main circuit in equipment inspection. As disclosed in Patent Literature 1, a movable contact on the grounding side is moved so as to come into contact with a fixed contact on the main circuit side to ground the main circuit. Before the movable contact is placed into contact with the fixed contact, the main circuit is supposed to be disconnected so that no voltage is applied to the fixed contact.

CITATION LIST

Patent Literature

Patent Literature 1: Japanese Patent Application Laid-open No. 2009-163946

SUMMARY

Technical Problem

Such switches are in some cases required to accomplish a duty to provide the capability to be turned on safely even when the movable contact is inadvertently brought into contact with the fixed contact while the main circuit is not disconnected and remaining closed. To accomplish this duty, it is necessary to reduce the duration of arc formation between the movable contact and the fixed contact. As a solution, an operation speed of the movable contact has been increased so as to reduce the time from arc formation until the movable contact comes into contact with the fixed contact. For enabling the movable contact to operate quickly, increase in size and cost of an operation device thus causes a problem.

The present invention has been achieved in view of the above, and an object of the present invention is to provide a switch that reduces the duration of arc formation and lowers an operation speed of a movable contact, thereby enabling reduction in size and cost of an operation device.

Solution to Problem

A switch according to an aspect of the present invention includes: a first contact placed so as to be capable of reciprocating in a first direction along an operation axis and in a second direction opposite the first direction; and a second contact placed on a side of the first direction of the first contact so as to be capable of reciprocating in the first direction along the operation axis and in the second direction. When the first direction is a direction from the first contact toward the second contact and the second direction is a direction opposite the first direction, the switch includes an urging part that urges the second contact in the second direction; an engaging part placed integrally with the second contact on the first direction side; and a conductor part placed away from the engaging portion in a direction perpendicular to the operation axis and electrically connected to the second contact. The switch also includes: a first magnetic material part surrounding the conductor part and made of a magnetic material; and a second magnetic material part placed between the first magnetic material part and the engaging part and made of a magnetic material. The second magnetic material part is placed at a position that causes, when no current flows through the conductor part, the second magnetic material part to engage with the engaging part to restrict the second contact from moving in the second direction due to the urging force. A space is provided between the second magnetic material part and the first magnetic material part to allow the second magnetic material part to move to a side of the first magnetic material part. The second magnetic material part moves to the side of the first magnetic material part so as to disengage from the engaging part.

Advantageous Effects of Invention

A switch according to the present invention lowers an operation speed of a movable contact, thereby enabling reduction in size of an operation device and increase in flexibility in design of the operation device.

DESCRIPTION OF EMBODIMENTS

Exemplary embodiments of a switch according to the present invention is described below in detail with reference to the drawings. The present invention is not limited to the embodiments.

First Embodiment

Figure 1:
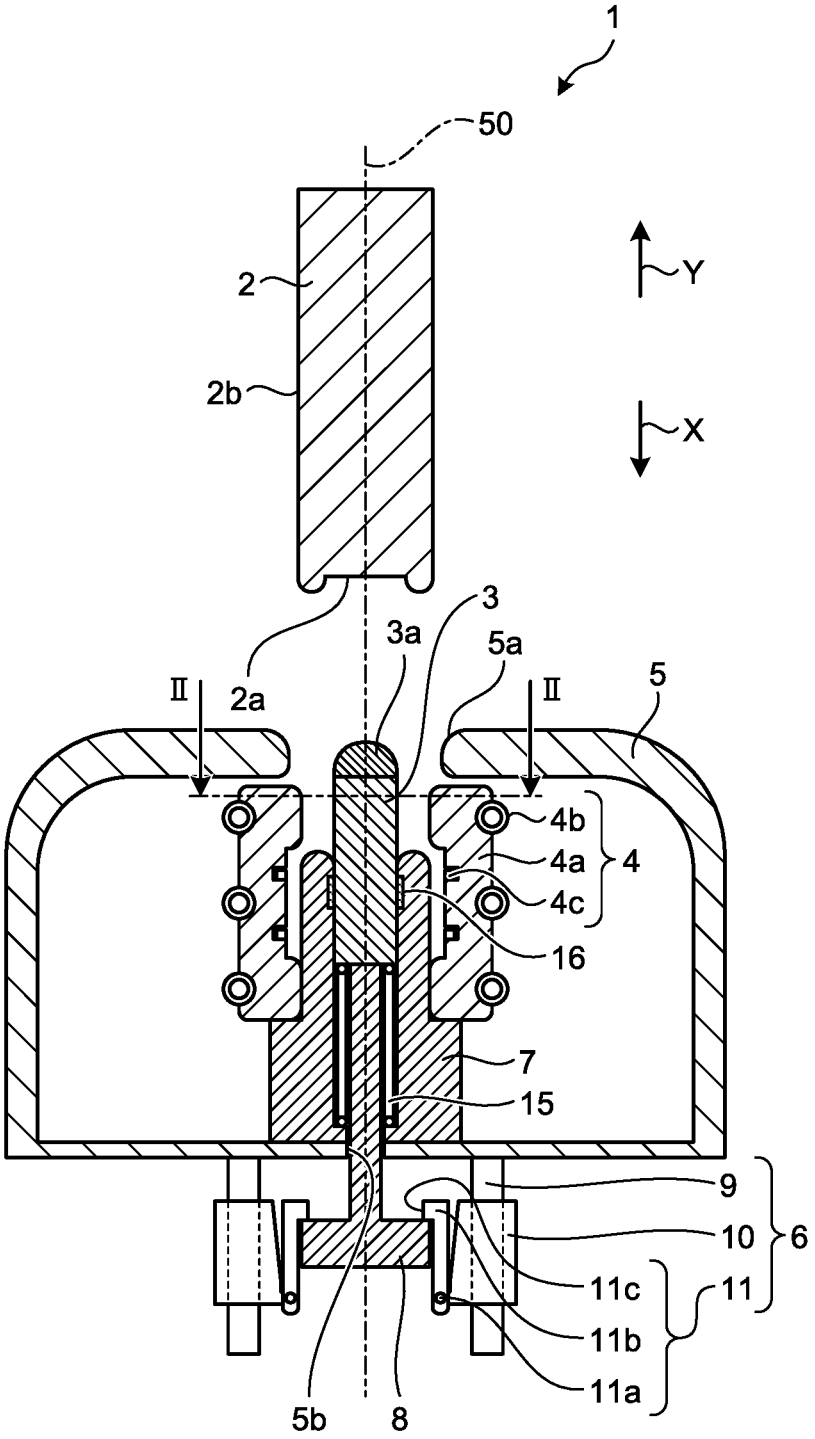
FIG. 1 is a sectional view illustrating a schematic configuration of a switch according to a first embodiment of the present invention.

FIG. 1 is a sectional view illustrating a schematic configuration of a switch according to a first embodiment of the present invention. A switch 1 is a grounding switch and placed in an undepicted tank that is filled with an insulating gas having electrical insulating and arc-extinguishing properties, such as sulfur hexafluoride ($SF_6$) gas. The switch 1 includes a movable contact 2 that is a first contact, an arc contact 3 that is a second contact, a fixed contact 4 that is a third contact, a shield 5, an engaging part 8, and an engaging mechanism 6.

The movable contact 2 and the arc contact 3 are placed on an identical operation axis 50 and face each other. In the disclosure below, a direction that is parallel with the operation axis 50 and directed from the movable contact 2 toward the arc contact 3 is a first direction and indicated by an arrow X in the drawings. A direction that is parallel with the operation axis 50 and directed from the arc contact 3 toward the movable contact 2 is a second direction and indicated by an arrow Y in the drawings.

The movable contact 2 is placed along the operation axis 50 and configured to reciprocate. The movable contact 2 is a conductor having a cylindrical shape, and the operation axis 50 serves as a central axis of the movable contact 2. As described below in detail, when the movable contact 2 moves in the direction indicated by the arrow X, an end portion 2*a* of the movable contact 2 located toward the direction indicated by the arrow X comes into contact with the arc contact 3, and a side face 2*b* of the movable contact 2 comes into contact with the fixed contact 4.

The arc contact 3 is retained by a guide part 7 that is made by using a conductor; the arc contact 3 is configured to reciprocate along the operation axis 50. A sliding contact 16 that is placed on the guide part 7 maintains electric connection between the arc contact 3 and the guide part 7. The arc contact 3 is a conductor having a cylindrical shape and centered on the operation axis 50. The arc contact 3 has an end portion 3*a* that is toward the direction indicated by the arrow Y and that is made of an arc resistant material. The guide part 7 surrounds the arc contact 3. The arc contact 3 is urged toward the direction indicated by the arrow Y by an urging part 15. The urging part 15 is, for example, a compression spring placed between the arc contact 3 and the guide part 7.

Figure 2:
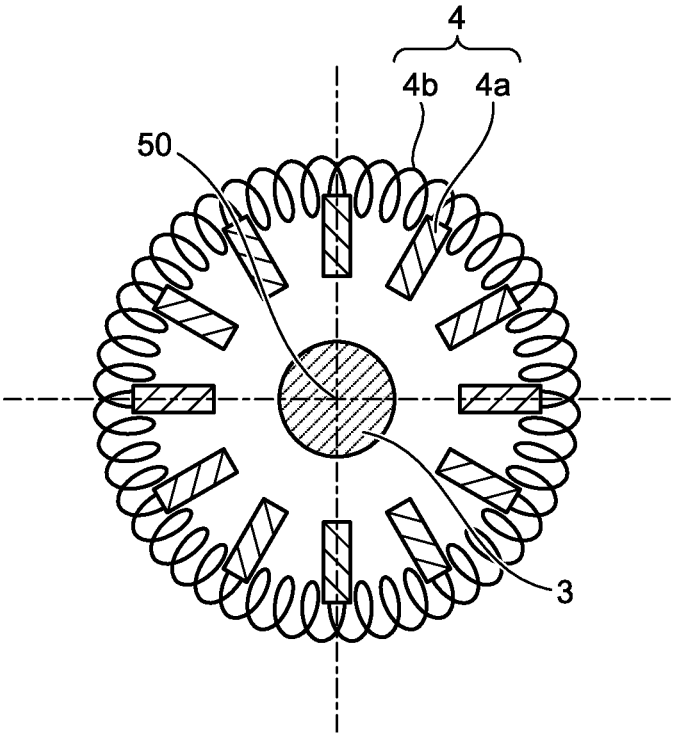
FIG. 2 is a sectional view illustrating a section along line II-II illustrated in FIG. 1.

FIG. 2 is a sectional view illustrating a section along line II-II illustrated in FIG. 1. The fixed contact 4 is placed around the arc contact 3 and centered on the operation axis 50. The fixed contact 4 includes a plurality of contact portions 4*a*, an urging portion 4*b*, and gap-forming portions 4*c*. As illustrated in FIG. 2, the plurality of contact portions 4*a* is arranged in an annular shape around the arc contact 3 and the guide part 7. The urging portion 4*b* is a spring member that has an annular shape and surrounds the plurality of contact portions 4*a* from outside; the urging portion 4*b* urges the plurality of contact portions 4*a* toward the operation axis 50. The gap-forming portion 4*c* is a member that has an annular shape and is placed inside the plurality of contact portions 4*a*; the gap-forming portions 4*c* are in contact with the plurality of contact portions 4*a*, which is arranged in the annular shape, from inside so as to form a gap between the arc contact 3 and the contact portions 4*a*. When the movable contact 2 is inserted into a space inside the plurality of contact portions 4*a*, which is arranged in the annular shape, the contact portions 4*a* come into contact with the side face of the movable contact 2. In the switch 1 according to the first embodiment, the movable contact 2 serves as a main contact on a movable side, and the contact portions 4*a* serves as a main contact on a fixed side.

The shield 5 is made of a conductor and accommodates the arc contact 3, the fixed contact 4, and the guide part 7. In a wall surface of the shield 5 located toward the direction indicated by the arrow Y, the first opening 5*a* is provided in an area that includes a portion of the shield 5 that intersects with the operation axis 50. The first opening 5*a* covers a periphery of the end portion 3*a* of the arc contact 3 in a state illustrated in FIG. 1. The first opening 5*a* is formed so as to have a size that allows the movable contact 2 and the arc contact 3 to pass therethrough.

A second opening 5*b* is formed in a wall surface of the shield 5 located toward the direction indicated by the arrow X. The wall surface of the shield 5 located toward the direction indicated by the arrow X is in contact with the guide part 7.

The engaging part 8 is made using an insulator. The engaging part 8 is integrated with the arc contact 3 and placed toward the direction indicated by the arrow X with respect to the arc contact 3. The engaging part 8 passes through the second opening 5*b*, which is formed in the shield 5, and a part of the engaging part 8 is located outside the shield 5.

Figure 3:
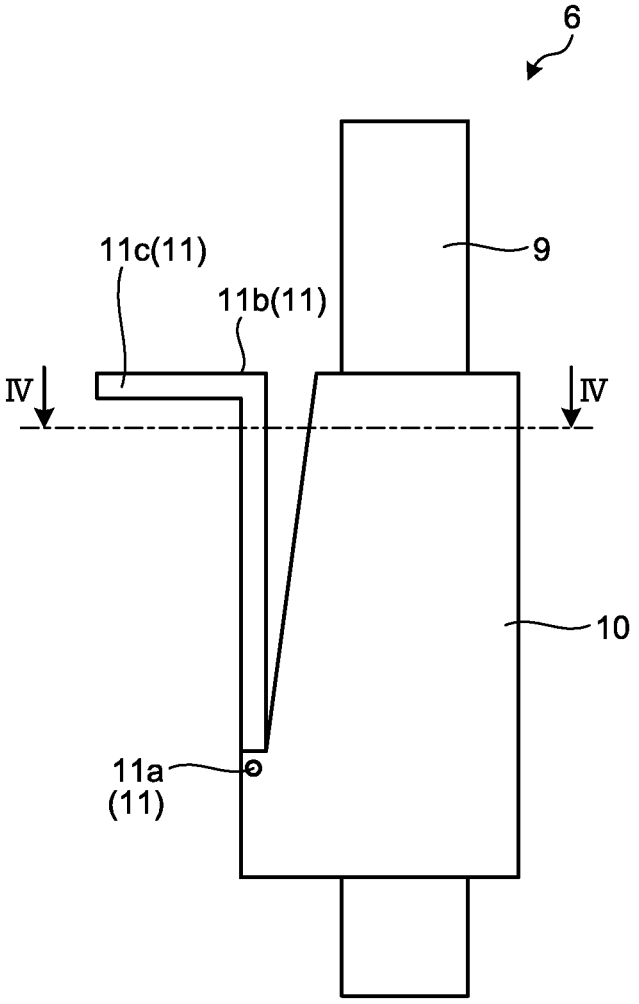
FIG. 3 is a diagram of an engaging mechanism according to the first embodiment when observed along a direction perpendicular to an operation axis.
Figure 4:
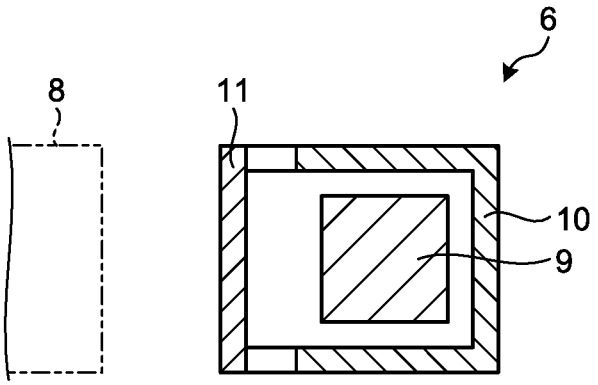
FIG. 4 is a sectional view illustrating a section along line IV-IV illustrated in FIG. 3.

The engaging mechanism 6 is placed outside the shield 5 away from the engaging part 8 in a direction perpendicular to the operation axis 50. The engaging mechanism 6 may be illustrated with hatching omitted to facilitate understanding. FIG. 3 is a diagram of the engaging mechanism 6 according to the first embodiment when observed along the direction perpendicular to the operation axis 50. FIG. 4 is a sectional view illustrating a section along line IV-IV illustrated in FIG. 3. The engaging mechanism 6 includes a conductor part 9, an attracting part 10 that is a first magnetic material portion, and a part to be attracted 11 that is a second magnetic material part.

The conductor part 9 is made of a conductor and placed away from the engaging part 8 in the direction perpendicular to the operation axis 50. The conductor part 9 is in contact with the shield 5 and electrically connected to the shield 5.

The attracting part 10 is made of a magnetic material. As illustrated in FIG. 4, the attracting part 10 has a shape that surrounds the conductor part 9 with a side of the engaging part 8 of the attracting part 10 open. The attracting part 10 is secured to the undepicted tank by an undepicted support part that is made of an insulator. The attracting part 10 may be secured to, in place of the tank, the conductor part 9 using a screw or an adhesive agent.

The part to be attracted 11 is made of a magnetic material. The part to be attracted 11 is placed between the engaging part 8 and the conductor part 9. In the first embodiment, the part to be attracted 11 is supported on the attracting part 10 by a pivot portion 11*a* that is placed on an end of the part to be attracted 11 located toward the direction indicated by the arrow X. The part to be attracted 11 is pivotable about the pivot portion 11*a*. The part to be attracted 11 is urged in a direction in which an edge portion 11*b* of the part to be attracted 11 located toward the arrow Y moves to the side of the engaging part 8. The urging force is given by, for example, a torsion spring placed at the pivot portion 11*a*.

A space is provided between the part to be attracted 11 and the attracting part 10 so as to allow the edge portion 11*b* of the part to be attracted 11 to move to a side of the attracting part 10. An engagement portion 11*c* that engages with the engaging portion 8 to restrict the engaging portion 8 from moving in the direction indicated by the arrow Y is formed on the edge portion 11*b* of the part to be attracted 11. In other words, the part to be attracted 11 restricts the arc contact 3, which is formed integrally with the engaging part 8, from moving in the direction indicated by the arrow Y due to the urging force of the urging part 15.

Figure 5:
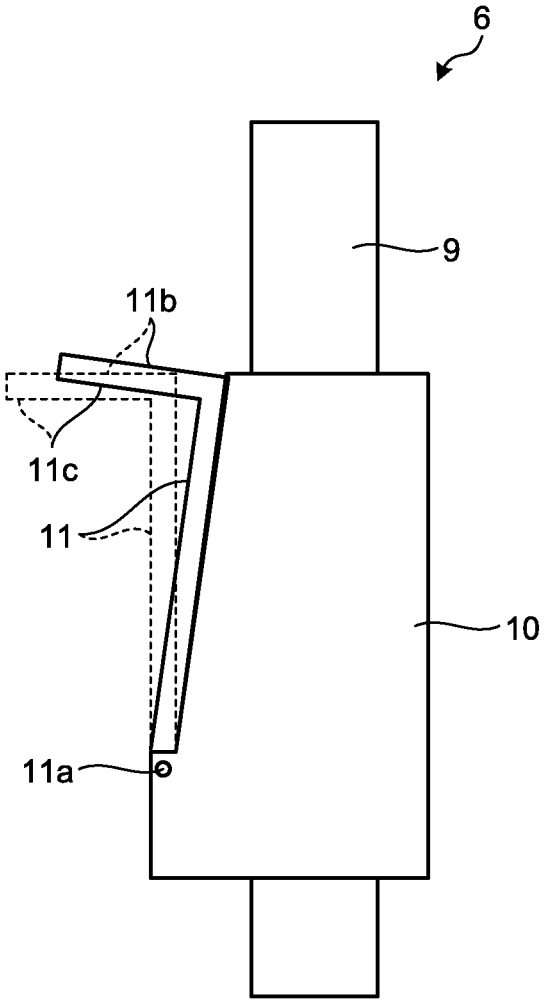
FIG. 5 is a side view illustrating a state of the engaging mechanism when current flows through a conductor part in the first embodiment.

An operation of the part to be attracted 11 performed when current flows through the conductor part 9 is described below. FIG. 5 is a side view illustrating a state of the engaging mechanism 6 when current flows through the conductor part 9 in the first embodiment. When current flows through the conductor part 9, an attractive force is generated between the attracting part 10 and the part to be attracted 11 due to a magnetic field generated around the conductor part 9. The part to be attracted 11 is thus attracted by the attracting part 10 against the urging force, and moves to the attracting part 10 side as illustrated in FIG. 5. When the part to be attracted 11 moves to a side of the attracting part 10, the engagement portion 11*c* is disengaged from the engaging part 8, and the arc contact 3 is allowed to move in the direction indicated by the arrow Y due to the urging force of the urging part 15.

Figure 6:
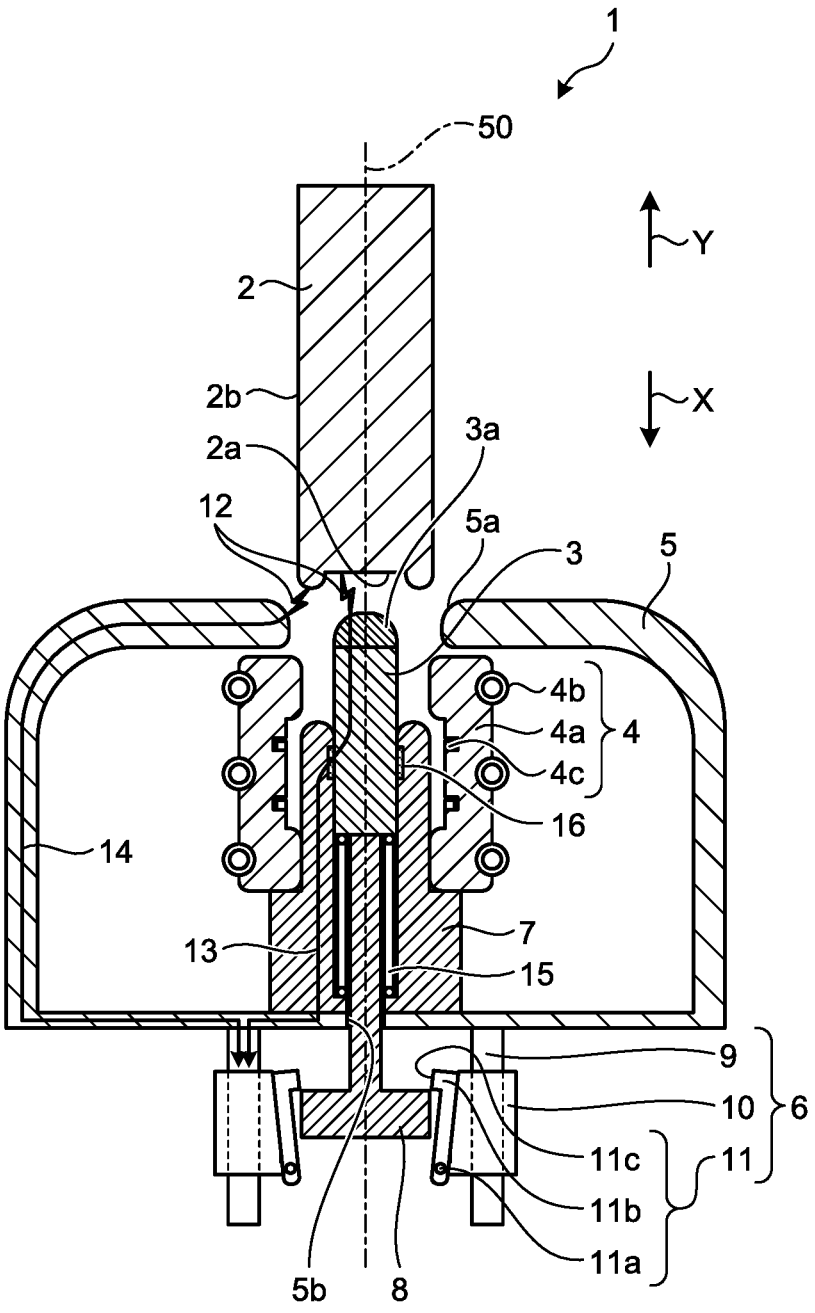
FIG. 6 is a diagram for describing an operation of the switch according to the first embodiment.
Figure 7:
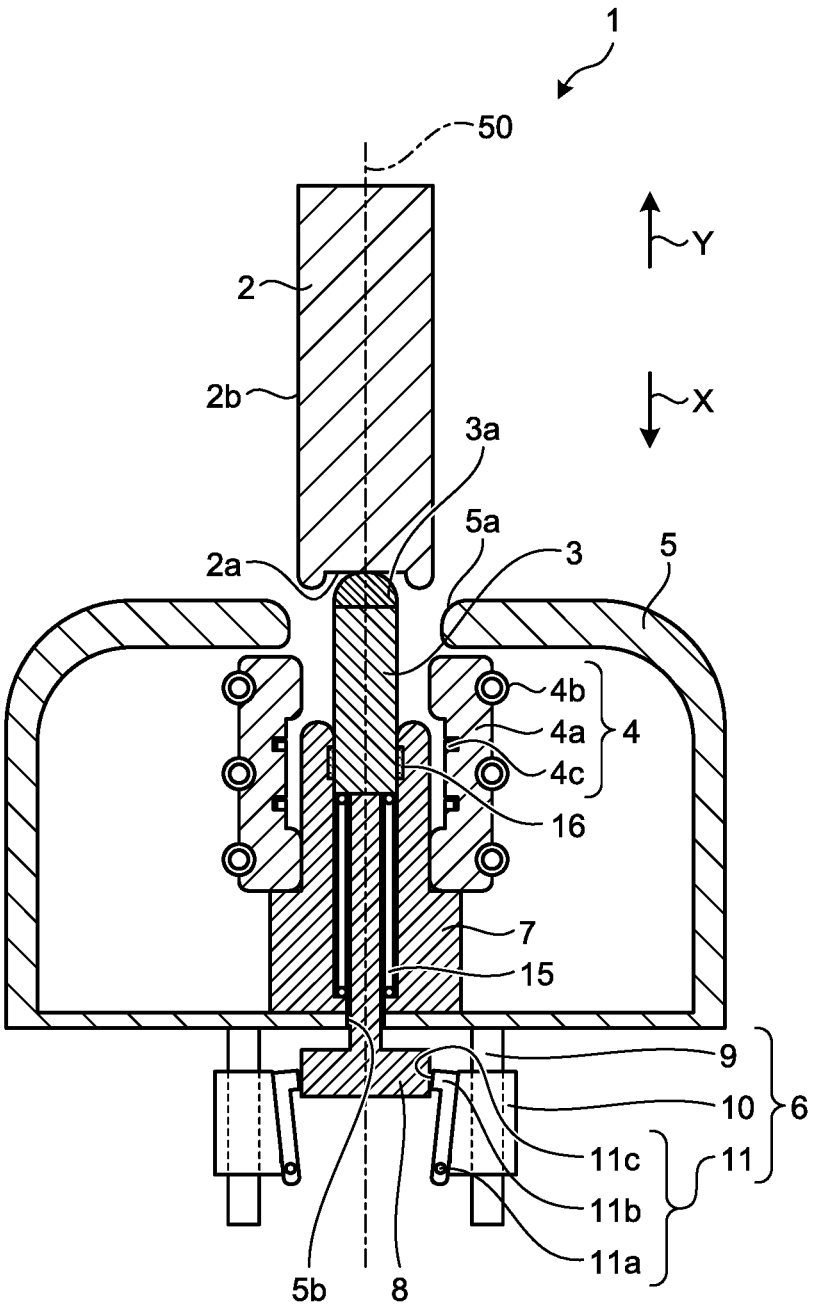
FIG. 7 is a diagram for describing the operation of the switch according to the first embodiment.
Figure 8:
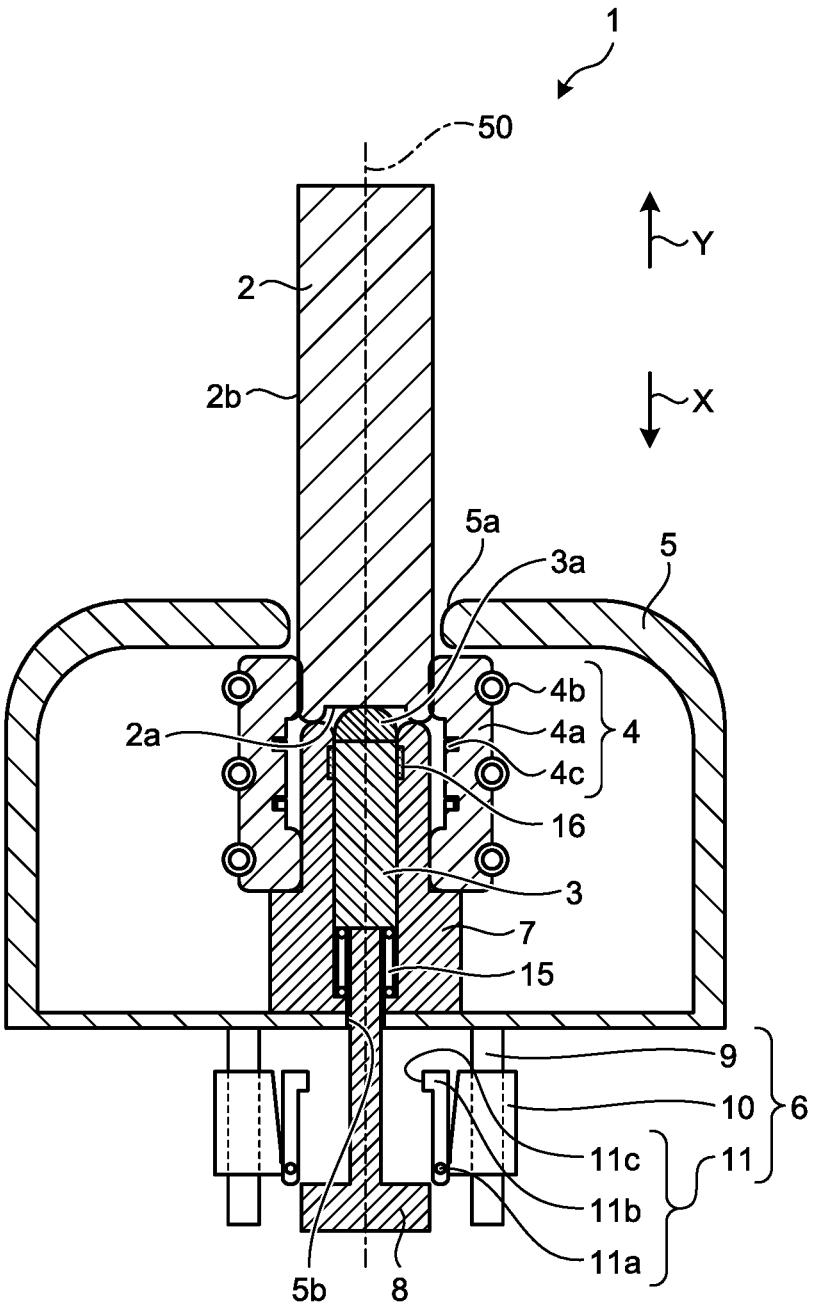
FIG. 8 is a diagram for describing the operation of the switch according to the first embodiment.

An operation of the switch 1 according to the first embodiment from when the movable contact 2 is moved in the direction indicated by the arrow X from a state illustrated in FIG. 1 until when the movable contact 2 and the contact portions 4*a* of the fixed contact 4 come into contact with each other is described next. FIGS. 6 to 8 are diagrams for describing the operation of the switch 1 according to the first embodiment.

As illustrated in FIG. 6, the movable contact 2 moves in the direction indicated by the arrow X, and a distance from the arc contact 3 and the shield 5 to the movable contact 2 is reduced. When a voltage is being applied to the arc contact 3 and the shield 5 at this point in time, an arc 12 is formed between the arc contact 3 and the movable contact 2 or between the shield 5 and the movable contact 2.

When the arc 12 is formed between the movable contact 2 and the arc contact 3, current flows through a path 13 illustrated in FIG. 6, that is, the current flows through the conductor part 9 via the arc contact 3, the sliding contact 16, the guide part 7, and the shield 5. When the current flows through the conductor part 9, the part to be attracted 11 is attracted by the attracting part 10. The engagement portion 11*c* is thus disengaged from the engaging part 8, and the arc contact 3 is allowed to move in the direction indicated by the arrow Y.

When the arc 12 is formed between the movable contact 2 and the shield 5, current flows through a path 14 illustrated in FIG. 6, that is, the current flows through the conductor part 9 via the shield 5. When the current flows through the conductor part 9, the part to be attracted 11 is attracted by the attracting part 10. The engagement portion 11*c* is thus disengaged from the engaging part 8, and the arc contact 3 is allowed to move in the direction indicated by the arrow Y.

In other words, current flows through the conductor part 9 and the arc contact 3 is allowed to move in the direction indicated by the arrow Y in both of the cases when the arc 12 is formed between the movable contact 2 and the arc contact 3 and when the arc 12 is formed between the movable contact 2 and the shield 5.

As illustrated in FIG. 7, the arc contact 3 thus moves in the direction indicated by the arrow Y, that is, toward the movable contact 2 due to the urging force of the urging part 15, and the end portion 2*a* of the movable contact 2 and the end portion 3*a* of the arc contact 3 come into contact with each other in both of the cases when the arc 12 is formed between the movable contact 2 and the arc contact 3 and when the arc 12 is formed between the movable contact 2 and the shield 5. When the end portion 2*a* of the movable contact 2 and the end portion 3*a* of the arc contact 3 come into contact with each other, the arc 12 extinguishes.

After the end portion 2*a* of the movable contact 2 and the end portion 3*a* of the arc contact 3 come into contact with each other, when the movable contact 2 further moves in the direction indicated by the arrow X, and the arc contact 3 is pushed in the direction indicated by the arrow X against the urging force of the urging part 15 as illustrated in FIG. 8. Then the movable contact 2 is inserted into the space inside the plurality of contact portions 4*a* which is arranged in the annular shape, and the side face 2*b* of the movable contact 2 comes into contact with the contact portions 4*a* of the fixed contact 4. When the switch 1 is a grounding switch, the side face 2*b* of the movable contact 2 and the contact portions 4*a* of the fixed contact 4 come into contact with each other and the grounding is completed.

After the grounding is completed, the part to be attracted 11 returns to a position away from the attracting part 10 when the current stops flowing through the conductor part 9. When the movable contact 2 is moved in the direction indicated by the arrow Y from the state illustrated in FIG. 8, the engagement portion 11*c* is engaged with the engaging part 8 during the process of moving the movable contact 2, and the state illustrated in FIG. 1 in which the movable contact 2 is away from the arc contact 3 is reinstated.

In the switch 1 described above, formation of the arc 12 between the arc contact 3 and the movable contact 2 or between the shield 5 and the movable contact 2 causes the arc contact 3 to move toward the movable contact 2, thereby enabling the movable contact 2 and the arc contact 3 to approach each other after the formation of the arc 12 at a relative velocity resulting from a moving speed of the movable contact 2 and a moving speed of the arc contact 3 added together.

To prevent damage to the movable contact 2 and the arc contact 3 due to the arc 12, the duration of the arc 12 formation is desirably reduced. When the duration of the arc 12 formation required to prevent damage to the movable contact 2 and the arc contact 3 is the same, the switch 1 according to the first embodiment, in which the arc contact 3 is moved toward the movable contact 2, can lower the moving speed of the movable contact 2 in comparison with a configuration in which only the movable contact 2 is moved. That is, the first embodiment can reduce the duration of arc formation and lower the moving speed of the movable contact 2.

The switch 1 according to the first embodiment can lower the moving speed of the movable contact 2 as described above, thus enabling reduction in size and cost of an undepicted operation device for operating the movable contact and also reduction in size and cost of the switch 1, which includes the operation device.

A configuration that exerts the urging force to move the part to be attracted 11 away from the attracting part 10 when current stops flowing through the conductor part 9 in the engaging mechanism 6, is not limited to a torsion spring. For example, the attracting part 10 and the part to be attracted 11 may be integrally formed. In this case, the part to be attracted 11 deforms when attracted by the attracting part 10, and a restoring force due to an elastic force of the part to be attracted 11 acts as the urging force when the part to be attracted 11 moves away from the attracting part 10. The engaging mechanism 6 may have any configuration as long as it can produce a force to move the part to be attracted 11 away from the attracting part 10 as described above. The switch 1 may be used as a disconnect switch other than a grounding switch.

Second Embodiment

Figure 9:
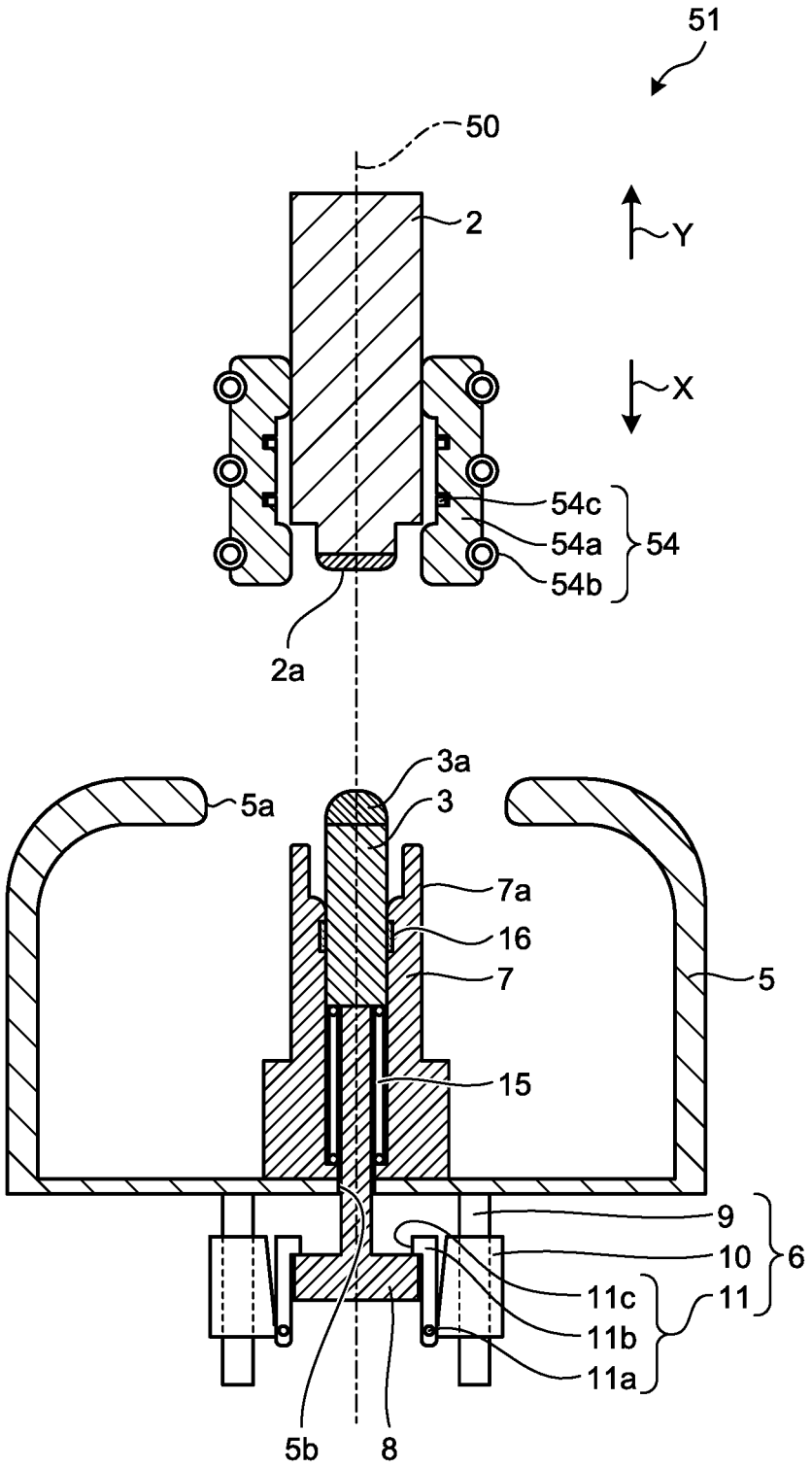
FIG. 9 is a sectional view illustrating a schematic configuration of a switch according to a second embodiment of the present invention.

FIG. 9 is a sectional view illustrating a schematic configuration of a switch according to a second embodiment of the present invention. Parts of a configuration similar to those in the first embodiment described above are designated with similar symbols and their detailed description will be omitted. In a switch 51 according to the second embodiment, a movable-side main contact 54 that includes contact portions 54*a*, an urging portion 54*b*, and gap-forming portions 54*c* similarly to the fixed contact 4 in the first embodiment is placed as the third contact on the movable contact 2. Specifically, a plurality of contact portions 54*a* is placed so as to surround the movable contact 2.

The movable-side main contact 54 moves together with the movable contact 2. When the movable-side main contact 54 moves in the direction indicated by the arrow X, the guide part 7 is allowed to be inserted into a space inside the contact portions 54*a* and a side face 7*a* of the guide part 7 comes into contact with the contact portions 54*a*. In other words, in the switch 51 according to the second embodiment, the contact portions 54*a* serve as the main contact on the movable side, and the guide part 7 is a fourth contact that serves as the main contact on the fixed side.

The first opening 5*a*, which is formed in the shield 5, is formed so as to have a size that allows movable-side main contact 54 to pass therethrough.

Figure 10:
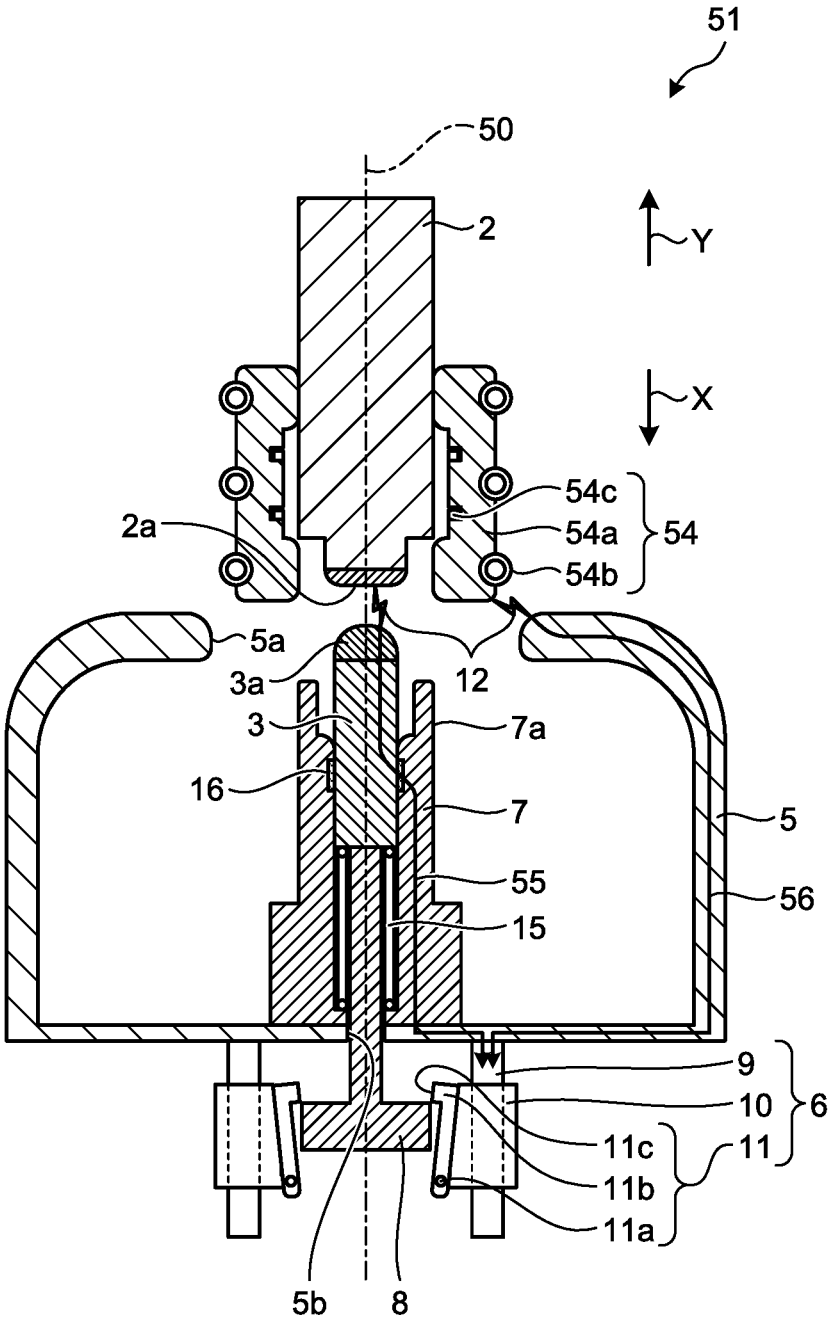
FIG. 10 is a diagram for describing an operation of the switch according to the second embodiment.
Figure 11:
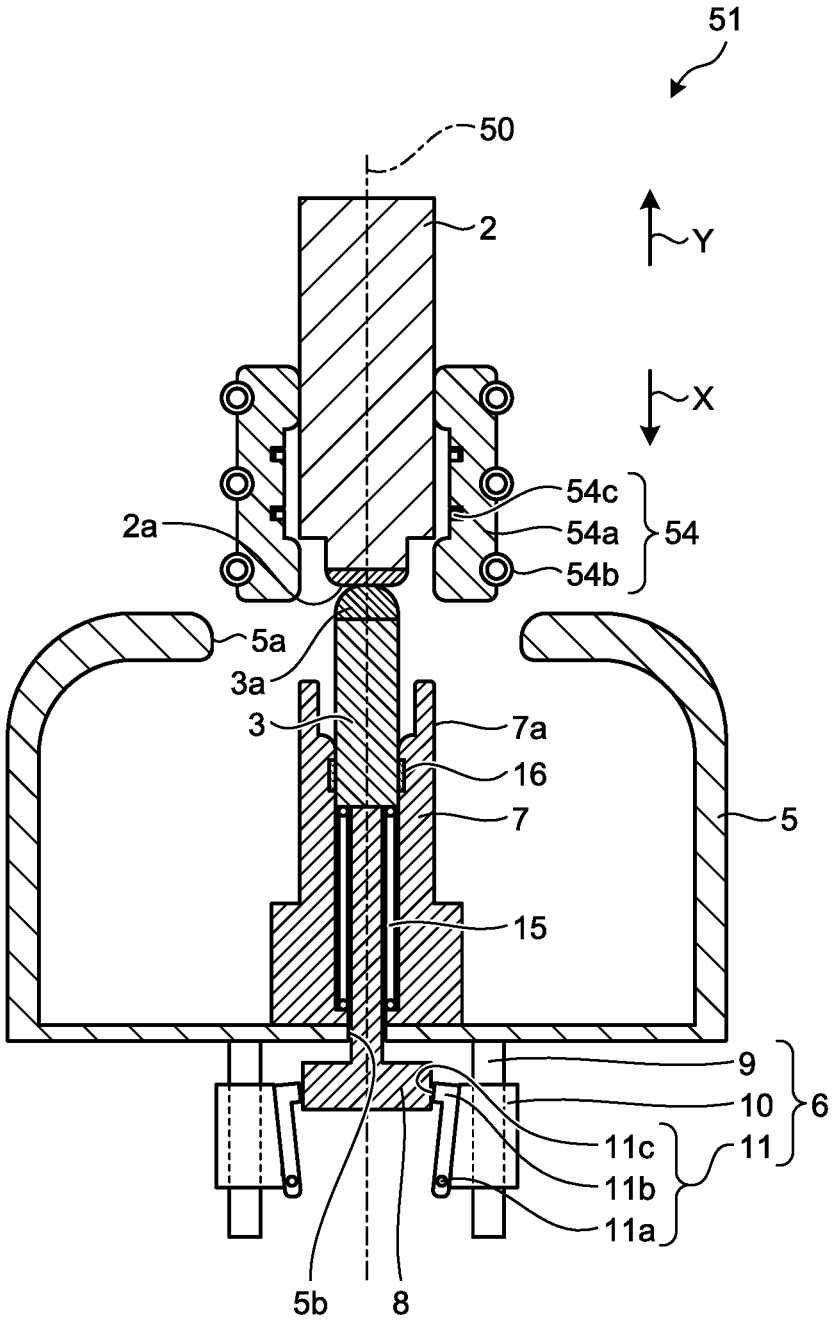
FIG. 11 is a diagram for describing the operation of the switch according to the second embodiment.
Figure 12:
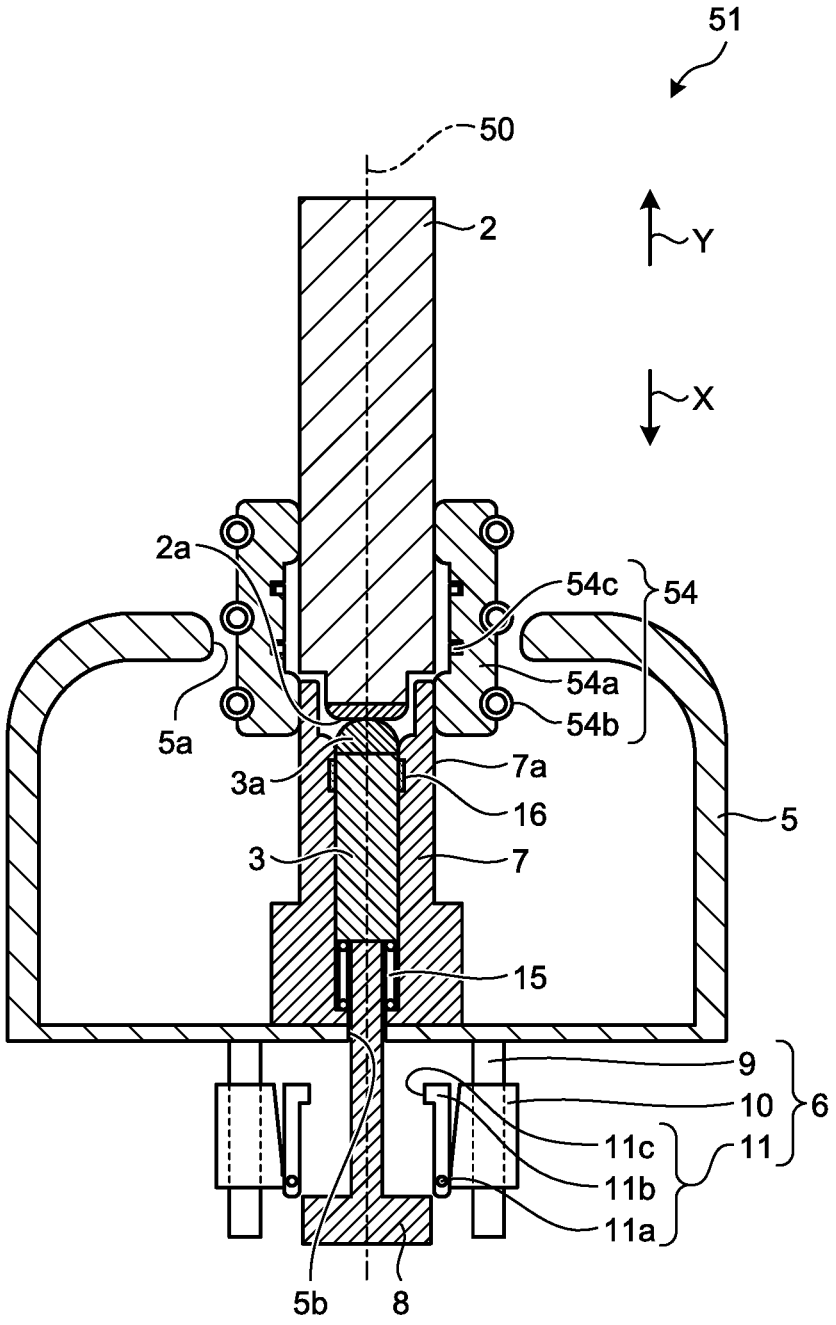
FIG. 12 is a diagram for describing the operation of the switch according to the second embodiment.

An operation of the switch 51 according to the second embodiment from when the movable contact 2 is moved in the direction indicated by the arrow X from a state illustrated in FIG. 9 until when the contact portions 54*a* of the movable-side main contact 54 and the side face 7*a* of the guide part 7 are placed into contact with each other is described next. FIGS. 10 to 12 are diagrams for describing the operation of the switch 51 according to the second embodiment.

As illustrated in FIG. 10, when the movable contact 2 moves in the direction indicated by the arrow X, a distance from the movable contact 2 and the movable-side main contact 54 to the arc contact 3 is reduced. When a voltage is being applied to the arc contact 3 and the shield 5 at this point in time, an arc 12 is formed between the movable contact 2 and the arc contact 3 or between the movable-side main contact 54 and the shield 5.

When the arc 12 is formed between the movable contact 2 and the arc contact 3, current flows through a path 55 illustrated in FIG. 10, that is, the current flows through the conductor part 9 via the arc contact 3, the sliding contact 16, the guide part 7, and the shield 5. When the current flows through the conductor part 9, the part to be attracted 11 is attracted by the attracting part 10. Thus, the engagement portion 11*c* is thus disengaged from the engaging part 8, and the arc contact 3 is allowed to move in the direction indicated by the arrow Y.

When the arc 12 is formed between the movable-side main contact 54 and the shield 5, current flows through a path 56 illustrated in FIG. 10, that is, the current flows through the conductor part 9 via the shield 5. When the current flows through the conductor part 9, the part to be attracted 11 is attracted by the attracting part 10. The engagement portion 11*c* is thus disengaged from the engaging part 8, and the arc contact 3 is allowed to move in the direction indicated by the arrow Y.

In other words, current flows through the conductor part 9 and the arc contact 3 is allowed to move in the direction indicated by the arrow Y in both of the cases when the arc 12 is formed between the movable contact 2 and the arc contact 3 and when the arc 12 is formed between the movable-side main contact 54 and the shield 5.

As illustrated in FIG. 11, the arc contact 3 thus moves in the direction indicated by the arrow Y, that is, toward the movable contact 2 due to the urging force of the urging part 15, and the end portion 2*a* of the movable contact 2 and the end portion 3*a* of the arc contact 3 come into contact with each other in both of the cases when the arc 12 is formed between the movable contact 2 and the arc contact 3 and when the arc 12 is formed between the movable-side main contact 54 and the shield 5. When the end portion 2*a* of the movable contact 2 and the end portion 3*a* of the arc contact 3 come into contact with each other, the arc 12 extinguishes.

After the end portion 2*a* of the movable contact 2 and the end portion 3*a* of the arc contact 3 come into contact with each other, the movable contact 2 further moves in the direction indicated by the arrow X, the arc contact 3 is pushed in the direction indicated by the arrow X against the urging force of the urging part 15 as illustrated in FIG. 12. When the guide part 7 is inserted into the space inside the contact portions 54*a*, which are arranged in the annular shape, the side face 7*a* of the guide part 7 comes into contact with the contact portions 54*a* of the movable-side main contact 54. When the switch 51 is a grounding switch, the side face 7*a* of the guide part 7 and the contact portions 54*a* of the movable-side main contact 54 come into contact with each other and the grounding is completed.

After the grounding is completed, the part to be attracted 11 returns to a position away from the attracting part 10 when the current stops flowing through the conductor part 9. When the movable contact 2 is moved in the direction indicated by the arrow Y from the state illustrated in FIG. 12, thereby enabling the engagement portion 11*c* to engage with the engaging part 8 during the process of moving the movable contact 2, and the state illustrated in FIG. 9 in which the movable contact 2 is away from the arc contact 3 is reinstated.

In the switch 51 described above, formation of the arc 12 causes the arc contact 3 to move toward the movable contact 2, thereby enabling the movable contact 2 and the arc contact 3 to approach each other after the formation of the arc 12 at a relative velocity resulting from a moving speed of the movable contact 2 and a moving speed of the arc contact 3 added together. The second embodiment thus can reduce the duration of arc formation and lower the moving speed of the movable contact 2, as in the case with the first embodiment. The second embodiment can also reduce the size and cost of an undepicted operation device for operating the movable contact 2 and reduce the size and cost of the switch 51, which includes the operation device.

The configurations in the embodiments described above represent some examples of the present invention, and they can be combined with another publicly known technique and partially omitted or modified without departing from the spirit of the present invention.

REFERENCE SIGNS LIST

1 switch; 2 movable contact (first contact); 2*a* end portion; 2*b* side face; 3 arc contact (second contact); 3*a* end portion; 4 fixed contact (third contact); 4*a* contact portion; 4*b* urging portion; 4*c* gap-forming portion; 5 shield; 5*a* first opening; 5*b* second opening; 6 engaging mechanism; 7 guide part; 7*a* side face; 8 engaging part; 9 conductor part; 10 attracting part (first magnetic material part); 11 part to be attracted (second magnetic material part); 11*a* pivot portion; 11*b* edge portion; 11*c* engagement portion; 12 arc; 13, 14 path; 15 urging part; 16 sliding contact; 50 operation axis; 51 switch; 54 movable-side main contact; 54*a* contact portion; 54*b* urging portion; 54*c* gap-forming portion; 55, 56 path.

The invention claimed is:

1. A switch comprising:

a first contact placed so as to be capable of reciprocating in a first direction along an operation axis and in a second direction opposite the first direction;

a second contact placed on a side of the first direction of the first contact so as to be capable of reciprocating along the operation axis in the first direction and in the second direction;

an urging part to urge the second contact in the second direction;

an engaging part placed integrally with the second contact on the first direction side of the second contact;

a conductor part placed away from the engaging part in a direction perpendicular to the operation axis and electrically connected to the second contact;

a first magnetic material part surrounding the conductor part and made of a magnetic material; and a second magnetic material part placed between the first magnetic material part and the engaging part and made of a magnetic material, wherein the second magnetic material part is placed at a position that causes, when no current flows through the conductor part, the second magnetic material part to engage with the engaging part to restrict the second contact from moving in the second direction due to urging force of the urging part, a space is provided between the second magnetic material part and the first magnetic material part to allow the second magnetic material part to move to a side of the first magnetic material part, and the second magnetic material part moves to the first magnetic material part side so as to disengage from the engaging part.

2. The switch according to claim 1, further comprising a shield having an opening provided in a portion of the shield that intersects with the operation axis, the opening having a size that allows the first contact and the second contact to pass through the opening, the opening covering a periphery of an end of the second contact located on a side of the second direction when the second magnetic material part engages with the engaging part, wherein the shield is electrically connected to the conductor part.

3. The switch according to claim 1, further comprising a third contact centered on the operation axis, placed around the second contact, and urged in a direction approaching the operation axis, wherein the third contact is capable of coming into contact with a side face of the first contact when the first contact moves in the first direction.

4. The switch according to claim 1, further comprising: a third contact centered on the operation axis, placed around the first contact, and urged in a direction approaching the operation axis; and a fourth contact centered on the operation axis and placed around the second contact, wherein the third contact is capable of coming into contact with a side face of the fourth contact when the first contact moves in the first direction.

* * * * *